US009683713B2

(12) United States Patent
Chartrand

(10) Patent No.: US 9,683,713 B2
(45) Date of Patent: Jun. 20, 2017

(54) INSERT FOR FLAMELESS CANDLE

(71) Applicant: Winvic Sales Inc., Markham (CA)

(72) Inventor: Mathieu Chartrand, Quebec (CA)

(73) Assignee: NII NORTHERN INTERNATIONAL INC., Vancouver (CA)

( * ) Notice: Subject to any disclaimer, the term of this patent is extended or adjusted under 35 U.S.C. 154(b) by 0 days.

(21) Appl. No.: 14/485,912

(22) Filed: Sep. 15, 2014

(65) Prior Publication Data

US 2015/0003076 A1 Jan. 1, 2015

Related U.S. Application Data

(63) Continuation of application No. 13/253,436, filed on Oct. 5, 2011, now Pat. No. 8,840,281.

(51) Int. Cl.
*F21S 6/00* (2006.01)
*F21S 10/04* (2006.01)
(Continued)

(52) U.S. Cl.
CPC ..... *F21S 6/001* (2013.01); *F21S 10/04* (2013.01); *F21V 1/00* (2013.01); *F21V 1/12* (2013.01);
(Continued)

(58) Field of Classification Search
CPC ..... F21S 6/001; F21S 10/04; F21S 10/043; F21V 1/00; F21V 1/12; F21V 1/16; F21V 3/04; F21V 3/0409; Y10S 362/81
See application file for complete search history.

(56) References Cited

U.S. PATENT DOCUMENTS 1,955,042 A 4/1934 Work
2,532,800 A 12/1950 Adinamis
(Continued)

FOREIGN PATENT DOCUMENTS

CN 200979145 11/2007
CN 201715265 1/2011
(Continued)

OTHER PUBLICATIONS

Canadian Intellectual Property Office, Search report, in Application No. 2,849,134, dated Aug. 13, 2015 (4 pages).
(Continued)

*Primary Examiner* — Alan Cariaso
(74) *Attorney, Agent, or Firm* — McAndrews, Held & Malloy, Ltd.

(57) ABSTRACT

A flameless candle includes a shell that has a sidewall and a hollow interior region. The sidewall can be made of a waxen material. The sidewall has a thickness and opacity. The shell also has a hollow interior region within the sidewall. A lamp (for example, LED) may be housed within the hollow interior region. The flameless candle also includes an insert. The insert can be made of a waxen material that may have different properties from the material of the sidewall. The insert is positioned in a top area of the hollow interior region. The insert includes a shading wall that has a thickness and opacity. The thickness of the sidewall may be different than the thickness of the shading wall. As another option, the opacity of the sidewall may be different from the opacity of the shading wall.

17 Claims, 2 Drawing Sheets

(51) Int. Cl.

| | |
|---|---|
| ***F21V 1/12*** | (2006.01) |
| ***F21V 1/00*** | (2006.01) |
| *F21V 1/16* | (2006.01) |
| *F21V 3/04* | (2006.01) |
| *F21Y 115/10* | (2016.01) |

(52) U.S. Cl.
CPC ..... *F21V 1/16* (2013.01); *F21V 3/0409* (2013.01); *F21Y 2115/10* (2016.08); *Y10S 362/81* (2013.01)

(56) References Cited

U.S. PATENT DOCUMENTS

| | | | | |
|---|---|---|---|---|
| 3,225,186 | A * | 12/1965 | Duncan | F21L 4/08 362/183 |
| 3,749,904 | A | 7/1973 | Graff | |
| 3,760,177 | A * | 9/1973 | Levy | F21S 6/001 362/311.01 |
| 3,761,702 | A | 9/1973 | Andeweg | |
| 3,890,085 | A | 6/1975 | Andeweg | |
| 4,074,165 | A | 2/1978 | Moriyama | |
| 5,081,568 | A | 1/1992 | Dong | |
| 5,622,423 | A | 4/1997 | Lee | |
| 5,697,695 | A | 12/1997 | Lin | |
| 6,309,092 | B1 * | 10/2001 | Bardeen | F21S 9/02 362/202 |
| 6,336,735 | B1 | 1/2002 | Eddins | |
| 6,361,192 | B1 | 3/2002 | Fussell | |
| 6,719,443 | B2 | 4/2004 | Gutstein | |
| 7,029,146 | B2 | 4/2006 | Kitchen | |
| 7,350,720 | B2 * | 4/2008 | Jaworski | A61L 9/03 239/34 |
| 7,422,355 | B2 * | 9/2008 | Hirata | F21S 6/001 362/161 |
| 7,633,232 | B2 * | 12/2009 | Wong | F21S 6/001 315/149 |
| 7,726,860 | B2 | 6/2010 | Harrity | |
| 7,784,959 | B2 | 8/2010 | Yang | |
| 8,371,740 | B2 | 2/2013 | Pestl | |
| 8,672,506 | B2 * | 3/2014 | Chen | F21L 4/02 362/183 |
| 8,783,888 | B2 * | 7/2014 | McCavit | A61L 9/122 362/162 |
| 9,163,798 | B2 * | 10/2015 | Chartreand | F21S 6/001 |
| 2002/0080604 | A1 | 6/2002 | Niermann | |
| 2007/0014107 | A1 | 1/2007 | Mishan | |
| 2007/0154857 | A1 * | 7/2007 | Cho | C11O 5/008 431/253 |
| 2008/0130266 | A1 * | 6/2008 | DeWitt | A61L 9/03 362/96 |
| 2009/0073678 | A1 | 3/2009 | Sherer | |
| 2009/0190334 | A1 * | 7/2009 | Yang | F21S 6/001 362/124 |
| 2010/0046240 | A1 | 2/2010 | Marden | |
| 2011/0057583 | A1 | 3/2011 | Fattizzi | |

FOREIGN PATENT DOCUMENTS

| | | |
|---|---|---|
| CN | 201739941 | 2/2011 |
| EP | 2278211 | 1/2011 |

OTHER PUBLICATIONS

PCT, Notification Concerning Transmittal of International Preliminary Report on Patentability, in International Application No. PCT/CA2012/000925, dated Apr. 17, 2014. (5 pages).

International Search Report and Written Opinion of the International Searching Authority, or the Declaration, in International Application No. PCT/CA2012/000925, dated Jan. 17, 2013 (9 pages).

European Patent Office, Communication with extended European search report, in Application No. 12838829.5, dated Apr. 10, 2015 (7 pages).

* cited by examiner

INSERT FOR FLAMELESS CANDLE

RELATED APPLICATION

This application is a continuation of U.S. application Ser. No. 13/253,436 filed Oct. 5, 2011, which is incorporated herein by reference in its entirety.

FEDERALLY SPONSORED RESEARCH OR DEVELOPMENT

[Not Applicable]

MICROFICHE/COPYRIGHT REFERENCE

[Not Applicable]

BACKGROUND OF THE INVENTION

Generally, this application relates to techniques for constructing flameless candles. Specifically, this application discloses the implementation of an insert for a flameless candle to improve the quality of emanating light.

Certain flameless candles may use a plastic shell. A light source may generate light that emanates through the shell. The plastic shell may be coated with a waxen material which is relatively thin. Such a plastic material may be useful because it may be relatively hard and can be machined or formed to relatively precise tolerances or specifications. For example, a plastic shell can be manufactured to have grooves, ledges, threads, etc., which may be more difficult or less durable if wax is used.

While plastic may have certain advantages over wax, it does not tend to diffuse light as one may expect from a traditional flamed candle. Thus, a plastic shell may create unwanted shadows or otherwise create a lighting effect that presents a poor illusion of a traditional candle.

Therefore, it may be useful to have a flameless candle that creates a better illusion of a traditional candle without sacrificing the benefits of certain aspects of plastic construction.

BRIEF SUMMARY OF THE INVENTION

According to embodiments of the present invention, a flameless candle includes a shell that has a sidewall and a hollow interior region. The sidewall can be made of a waxen material. The sidewall has a thickness and opacity. The shell also has a hollow interior region within the sidewall. A lamp (for example, LED) may be housed within the hollow interior region.

The flameless candle also includes an insert. The insert can be made of a waxen material that may have different properties from the material of the sidewall. The insert is positioned in a top area of the hollow interior region. The insert includes a shading wall that has a thickness and opacity. The thickness of the sidewall may be different than the thickness of the shading wall. As another option, the opacity of the sidewall may be different from the opacity of the shading wall.

In an embodiment, the shell has an aperture that allows the insert to be positioned within the top area of the hollow interior region. In another embodiment, the shading wall acts as a sidewall around the lamp. In another embodiment the shading wall of the insert forms a top wall above the lamp. In another embodiment, the shading wall of the insert comprises a hollow interior region configured to cover the lamp.

Figure 1A:
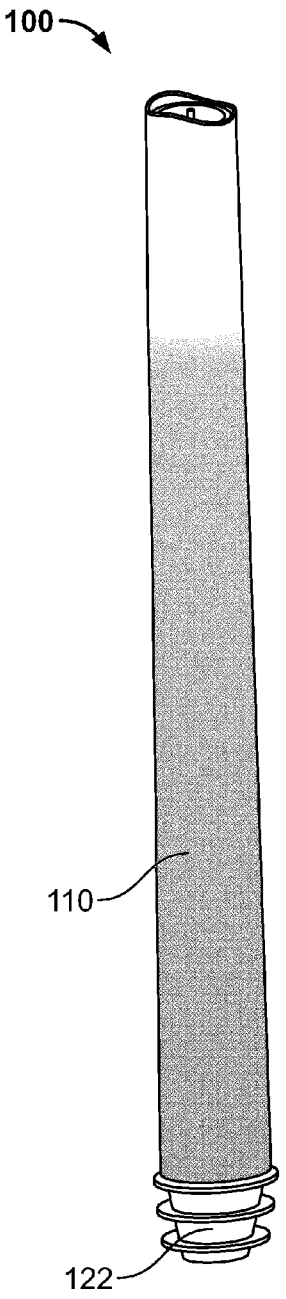
FIG. 1A shows a flameless candle, according to an embodiment of the present invention.

The foregoing summary, as well as the following detailed description of certain embodiments of the present invention, will be better understood when read in conjunction with the appended drawings. For the purposes of illustration, certain embodiments are shown in the drawings. It should be understood, however, that the claims are not limited to the arrangements and instrumentality shown in the attached drawings. Furthermore, the appearance shown in the drawings is one of many ornamental appearances that can be employed to achieve the stated functions of the system.

DETAILED DESCRIPTION OF THE INVENTION

Figure 1B:
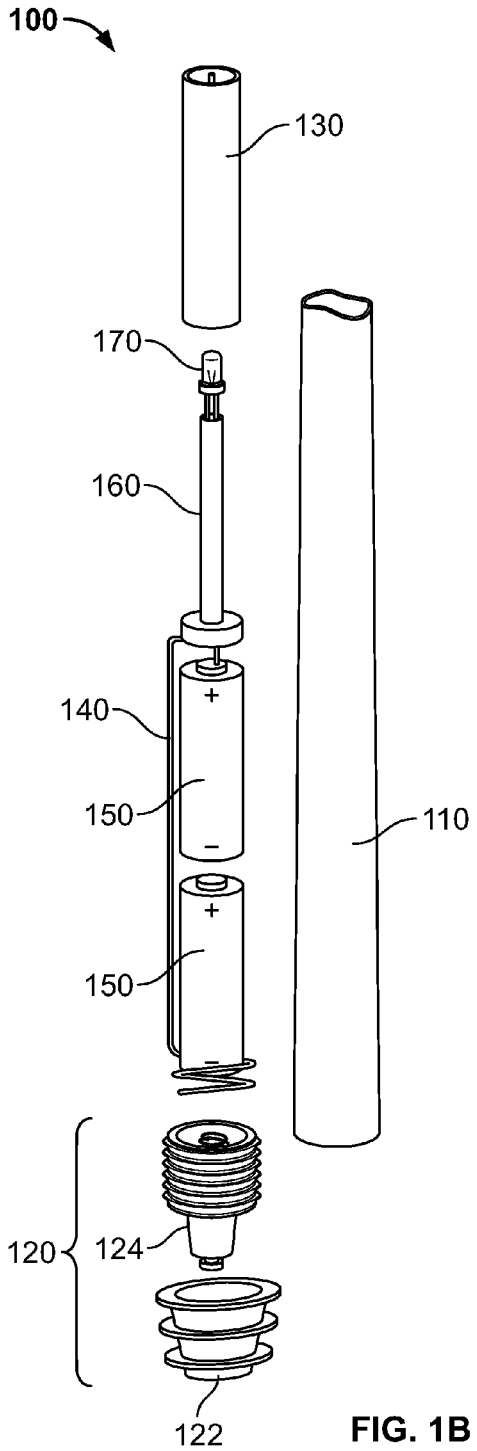
FIG. 1B shows an exploded view of a flameless candle, according to an embodiment of the present invention.

FIGS. 1A and 1B show a flameless candle 100, according to an embodiment of the present invention. The flameless candle 100 may include a shell 110, a cap 120, an insert 130, an electrical conductor 140, one or more batteries 150, a separation portion 160, a lamp 170 (for example, LED), and a wick (for example, a simulated wick).

The shell 110 may be made of a wax or waxen material. The housing 110 may have a battery compartment to house the batteries 150 (for example, two batteries in series). The shell 110 may also have a compartment to house the separation portion 160, the lamp 170, or the insert 130. The shell 110 may have an opening (for example, through the bottom) to receive the batteries 150. A mating portion (for example, female threads) may also be located near the bottom of the shell 110 to mate with the cap 120. The shell 110 may include a sidewall that may be formed of or include a waxen material. The sidewall may have a thickness and opacity. A hollow interior region within the sidewall may house the lamp 170.

The separation portion 160 may separate the lamp 170 (for example, an LED) from a terminal of one of the batteries 150. The separation portion 160 may accommodate one or more conductors to provide power to the lamp 170. The separation portion 160 or the lamp 170 may also accommodate additional electronics (for example, a flickering circuit, a current limiting resistor, etc.) for the candle 100.

The conductor 140 may extend from the separation portion 160 or lamp 170 and past the distal battery terminal. The conductor 140 may extend through the separation portion and to the lamp 170. For example the conductor 140 may be directly soldered or connected to one of the leads of the lamp 170.

Figure 2:
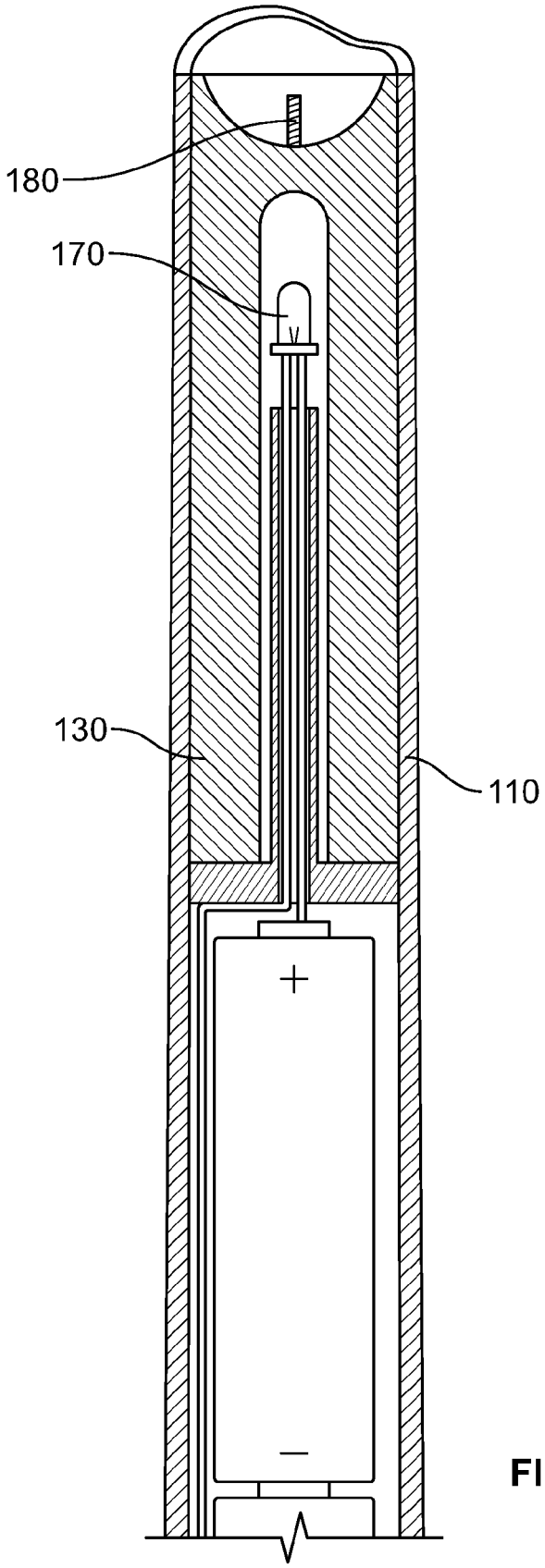
FIG. 2 shows a cross-sectional view of a flameless candle including an insert, according to an embodiment of the present invention.

FIG. 2 shows a cross-sectional view of a flameless candle 100 including an insert 130, according to an embodiment of the present invention. The insert 130 may be formed of or include a waxen material. The insert may be positioned in a top area of the hollow interior region of the shell 110. The shell 110 may have an aperture that allows the insert 130 to be positioned within the top area of the hollow interior region of the shell 110. The insert 130 may have at least one shading wall that has a thickness and opacity.

The plastic shell 110 may diffuse light from the lamp 170 in a way that does not effectively present an illusion of a traditional flamed candle. The insert 130, however may diffuse light from the lamp 170 in a more natural way and without unwanted shadows. By selecting the opacity or thickness of the insert 130, it may be possible to control the illumination of the candle 100.

The thickness of the sidewall of the shell 110 may be different from the thickness of the shading wall of the insert 130. Additionally, the opacity of the sidewall of the shell 110 may be different from the opacity of the shading wall of the insert 130. Moreover, the qualities of light diffusion between the shell 110 and insert 130 may also be different. These and other qualities of the insert 130 may diffuse light from the lamp in a more natural or desirable manner.

The insert 130 may also improve illumination characteristics of a colored candle. For example, when colored materials (for example, colored waxes) are used, the colorations may interfere with the light from a light source. For example, red pigments in wax may interfere with the intensity of light that is emitted by a light source in a candle. However, by using an insert 130 that has a neutral color (for example, white), the shell 110 or waxen coating may be colored. This configuration may improve the intensity and quality of illumination from a colored flameless candle 100 (for example, a red candle or a blue candle).

The shading wall of the insert 130 may include a sidewall around the lamp. The shading wall of the insert 130 may include a hollow interior region that covers the lamp 170. Additionally, the shading wall of the insert 130 may have a top wall above the lamp 170. A simulated wick 180 may be positioned above the top wall of the insert 130 and above the lamp 170.

While the invention has been described with reference to certain embodiments, it will be understood by those skilled in the art that various changes may be made and equivalents may be substituted without departing from the scope of the invention. In addition, many modifications may be made to adapt a particular situation or material to the teachings of the invention without departing from its scope. Therefore, it is intended that the invention not be limited to the particular embodiment disclosed, but that the invention will include all embodiments falling within the scope of the appended claims.

The invention claimed is:

1. A flameless candle comprising:

a shell including:

a shell sidewall having a thickness and an opacity;

a hollow interior region defined by the shell sidewall; and a first aperture on an upper end of the shell, wherein the first aperture has a minimum radius along a horizontal dimension;

a lamp positioned in the hollow interior region of the shell;

the lamp is positioned in an upper region of the hollow interior region;

an insert positioned in the hollow interior region of the shell, wherein:

the insert includes an insert sidewall and an insert top wall integrated with the insert sidewall;

the insert has a maximum radius along a horizontal dimension;

the insert sidewall has at least a thickness different from shell sidewall or an opacity different than the opacity of the shell;

the insert sidewall is interposed between the lamp and the sidewall of the shell with at least a portion of the insert sidewall abutting against the shell sidewall; and the insert is positioned in the upper region of the hollow interior region;

a path between the lamp and the insert sidewall is unobstructed; and the lamp is entirely within the insert; and wherein:

the first aperture is configured to pass the insert through such that the insert can be positioned in the hollow interior region of the shell and the insert is interposed between the lamp and the sidewall of the shell; and the minimum radius of the first aperture is greater than the maximum radius along the horizontal dimension of the insert.

2. The flameless candle of claim 1, wherein:

the thickness of the shell sidewall is different from the thickness of the insert sidewall; and the opacity of the shell sidewall is different from the opacity of the insert sidewall.

3. The flameless candle of claim 1, wherein the insert sidewall comprises a hollow interior region configured to cover the lamp.

4. The flameless candle of claim 1, wherein the insert top wall comprises a recess.

5. The flameless candle of claim 1, further comprising a simulated wick extending from the top wall of the insert.

6. The flameless candle of claim 1, further comprising a flickering circuit.

7. The flameless candle of claim 1, wherein the insert comprises a waxen material.

8. The flameless candle of claim 1, wherein the shell comprises a waxen material.

9. The flameless candle of claim 1, wherein the shell comprises a second aperture on a lower end of the shell.

10. The flameless candle of claim 9, wherein the second aperture on the lower end of the shell is sized to receive at least one battery.

11. The flameless candle of claim 10, further comprising a cap and wherein:

the shell further comprises a mating portion proximate the aperture on the lower end of the shell; and the mating portion is configured to mate with the cap.

12. The flameless candle of claim 11, further comprising a separation portion arranged to separate the lamp from a battery compartment in the hollow interior region of the shell that houses at least one battery.

13. The flameless candle of claim 12, wherein the battery compartment is sized to hold two batteries in series.

14. The flameless candle of claim 12, wherein the insert does not extend below the separation portion.

15. The flameless candle of claim 14, wherein the insert abuts a top surface of the separation portion.

16. The flameless candle of claim 12, further comprising a first conductor that extends upwardly from the separation portion to a lead of the lamp.

17. The flameless candle of claim 16, further comprising a second conductor that extends downwardly from a lead of the lamp and through the separation portion, such that a lower region of the second conductor abuts a terminal of a battery inserted into the battery compartment.

* * * * *